United States Patent [19]

Mayer et al.

[11] 4,093,689

[45] June 6, 1978

[54] PROCESS FOR PRODUCING REINFORCED CONCRETE BUILDING UNITS, ESPECIALLY FLOOR PANELS HAVING SMOOTH SURFACES AND COFFER-LIKE INNER HOLES, AND FORMWORK ESPECIALLY FOR CARRYING OUT THE PROCESS

[75] Inventors: György Mayer; János Györi; Mihály Rikker; Antal Bánfai; Ervin Eszenyl, all of Pecs, Hungary

[73] Assignee: Licencia Talalmanyokat Ertekesito Vallalat, Budapest, Hungary

[21] Appl. No.: 451,199

[22] Filed: Mar. 14, 1974

[51] Int. Cl.[2] ..... B28B 1/08

[52] U.S. Cl. ..... 264/71; 52/223 R; 264/228; 264/250; 264/275; 264/299

[58] Field of Search ..... 264/333, 275, 69, 71, 264/228, 31, 34, 35, 250, 299; 52/223 R

[56] References Cited

U.S. PATENT DOCUMENTS

| | | | |
|---|---|---|---|
| 2,039,398 | 5/1936 | Dye | 52/223 R |
| 2,465,871 | 3/1949 | Hardie et al. | 264/31 |
| 2,892,339 | 6/1959 | Flower et al. | 264/71 |
| 3,088,187 | 5/1963 | Jastice | 264/275 |
| 3,388,452 | 6/1968 | Connolly | 264/31 |
| 3,475,529 | 10/1969 | Lacy | 264/228 |

FOREIGN PATENT DOCUMENTS

| | | | |
|---|---|---|---|
| 1,087,262 | 10/1967 | United Kingdom | 264/333 |

*Primary Examiner*—Robert F. White
*Assistant Examiner*—John A. Parrish
*Attorney, Agent, or Firm*—Young & Thompson

[57] ABSTRACT

A process for producing reinforced concrete building units such as concrete floor panels having coffer-like inner holes with smooth upper and lower surfaces, comprises providing a layer of reinforced concrete on the lower edges of a building unit comprised by an upper panel and joining ribs intersecting each other. A reinforcing steel mat is secured to the lower edges of the ribs which is then immersed in a layer of concrete resting on a plate. The assembly is vibrated to consolidate the concrete around the mat and after hardening, the plate is removed, leaving a smooth undersurface on the resulting hollow construction. The panel can be prestressed to a downwardly convex shape, in which case the plate is given a corresponding upwardly concave curvature.

2 Claims, 13 Drawing Figures

PROCESS FOR PRODUCING REINFORCED CONCRETE BUILDING UNITS, ESPECIALLY FLOOR PANELS HAVING SMOOTH SURFACES AND COFFER-LIKE INNER HOLES, AND FORMWORK ESPECIALLY FOR CARRYING OUT THE PROCESS

The invention relates to a process for producing reinforced concrete building units, especially reinforced concrete floor panels having coffer-like inner holes, with lower and upper smooth surfaces.

It is a requirement of the floors of residential buildings and public buildings to have smooth surfaces at the bottom and on the top. The production of monolithic concrete of such floors is, however, uneconomical, and the prefabricated floor units smooth at the bottom and on the top have a great dead weight, thus they can be produced only with small dimensions, being, of course, thus very expensive.

The coffered prefabricated floor units ribbed at the bottom would be cheap, as their production would be possible with essentially larger dimensions than other floor panels provided, e.g. with longitudinal parallel inner holes. However, the smooth ceiling surface can be ensured only by suspended ceiling or plastered ceiling requiring much labour and expense, the advantages of the reinforced concrete floor units ribbed at the bottom are lost. Moreover, the organic cooperation of the suspended ceiling with the floor cannot be achieved always with safety, the suspended ceiling may crack, the connections may become damaged etc.

Attempts were made for the production of floor panels provided with smooth surfaces at the bottom and on the top, having coffered holes internally, which, however, can be achieved exclusively by using remanent formwork or coffering units, rendering the production of floor panels of such type uneconomical.

The structural development of production forms means also a disadvantageous factor in the present production engineering of floor units — and generally of building units. In the prevailing opinion of the profession, one of the most important demands raised against the form is that it should be the most rigid possible for the sake of achievement of the planned dimensions and the required smooth surfaces. Therefore, massive bracing rail constructions are used to which the rigid form plates are fastened generally by welding. Just due to the welding, however, the form plate often warps and the surface of the produced element deviates from the plane. These forms are labour intensive, expensive, their wear results not only in the loss of form plates but of the entire bracing structure, constituting similarly a disadvantageous cost factor.

The invention aims at the development of a process, by means of which prefabricated floor units having large smooth surfaces at the bottom and on the top and inner holes can be produced on an industrial scale.

According to the invention this task has been performed by means of a process, the essence of which consists in that to the bottom ends of ribs of a building-unit part consisting expediently of sheet and ribs intersecting each other, connected thereto, iron armouring, especially steel mat is connected, the iron armouring is buried in a raw concrete layer and the raw concrete layer is combined with the iron armouring to a reinforced concrete plate expediently by means of vibration. The steel mat is expediently connected to the building-unit part by means of spikes arranged in the coffers concreted in the lower ends of the ribs.

According to a further, highly advantageous execution method ensuring the crack-free bottom surface of the floor unit of the process according to the invention, the ribbed building-unit part provided with iron armouring is spanned in a manner, resulting in compressive stress in the plate and in tensile stress in the lower part of ribs, the iron armouring is buried in the raw concrete layer in this stressed state and the building-unit part is kept in this stressed state at least until the partial solidification of the raw concrete layer.

It is possible— by means of the invention — to produce floor units having large smooth surfaces at the bottom and on the top and internal coffer-holes without remanent formwork, for the first time in largescale belt-conveyor-like production. The weight of the manufactured large-surface floor elements is relatively low; the specific weight of floor unit suitable for carrying a working load of 400 kg/sq.m is less than 200 kg/sq.m. No subsequent production of suspended ceiling or plastered ceiling is necessary, the development of the final smooth surface is carried out in the workshop. The production costs per unit do not exceed the costs of the floor elements ribbed at the bottom, having thus no smooth bottom surface. The floor elements produced with the application of the process according to the invention can be universally used for the construction of high, middle and single-stage public-buildings and residential buildings.

From the recognition that instead of highly rigid form plates, thin and flexible plates can be used for the production of forms for building unit manufacture, essential advantages follow both in functional and economical respects. The smooth surface can be namely adjusted considerably more accurately and safely with the form according to the invention than with the conventional rigid structures; moreover, curved surfaces can be also developed which are highly advantageous for the effectuation of the process according to the invention. Costwise, on the other hand, the form according to the invention is favourable since in case of fatique of the flexible form plate, only this plate shall be replaced, whereas the form-founding — being not welded together with the form plate — remains unchanged.

The invention will now be described in more detail on the basis of the enclosed drawings, illustrating the individual phases of an advantageous effectuation method of the process and a reinforced concrete element — in the present case a floor element — obtained as a result of the manufacture, respectively.

In the drawings:

FIG. 1*a* shows the part of the building unit according to the invention made in the first phase of production, in section taken along the line A—A in FIG. 1*b;*

FIG. 1*b* indicates the section taken along the line B—B marked in FIG. 1*a;*

FIG. 2*a* demonstrates the detail "*a*" marked in FIG. 1*a* in larger proportion;

FIG. 2*b* is the view in direction of arrow "*c*" marked in FIG. 2*a;*

FIG. 3 shows the second phase of the process where the iron armouring is already buried in the raw concrete arranged on the production tray;

FIG. 4 demonstrates the detail "*b*" marked in FIG. 3;

FIG. 5 is the moment diagram corresponding to the prestressed state of the element part produced in the first phase;

FIG. 6 indicates a possible method of prestressing the element part according to FIGS. 1*a* and 1*b;*

Figure 8:
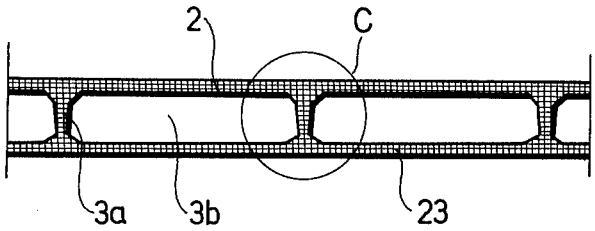
FIG. 8 represents the finished building unit.
Figure 9:
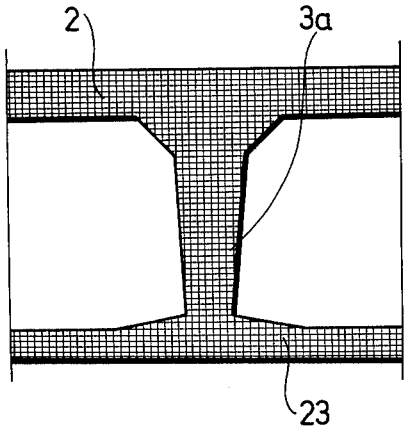
Figure 10:
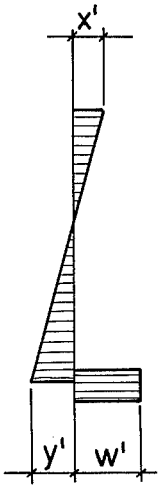
Figure 11:
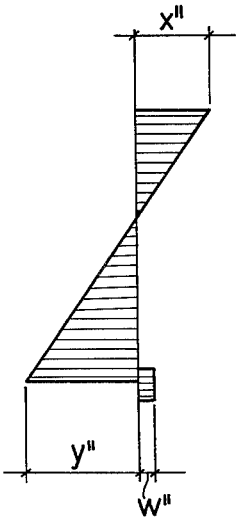

FIG. 9 demonstrates the detail "*c*" marked in FIG. 8, in larger proportion;

FIG. 10 is the moment diagram of the building unit according to the invention, in its state of inertia;

FIG. 11 represents the moment diagram of the building unit according to the invention, under the effect of the proper working load.

Figure 1A:
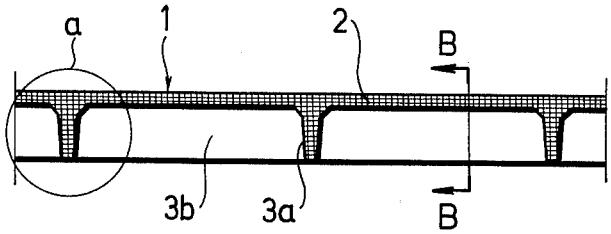
Figure 1B:
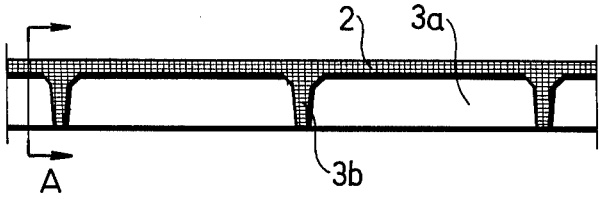

In FIGS. 1*a* and 1*b* a piece of the reinforced concrete floor unit part made in the first phase of the process according to the invention and marked with reference number 1, consisting of the upper plate 2 and of the ribs 3*a*, 3*b* located normally to each other is shown. The floor unit part is produced in a coffered steel form. The construction of this form may be also conventional, in case of using the form according to the invention, however, — which will be described in more detail later on — the floor-unit part 1 can be developed with a convex spatial shape deviating from the horizontal.

Figure 2A:
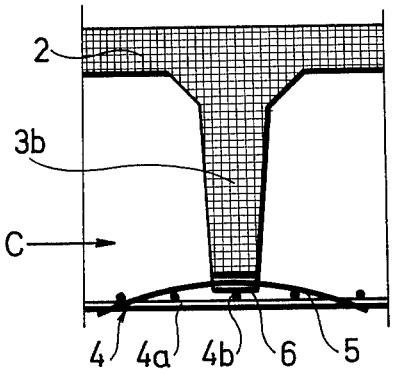
Figure 2B:
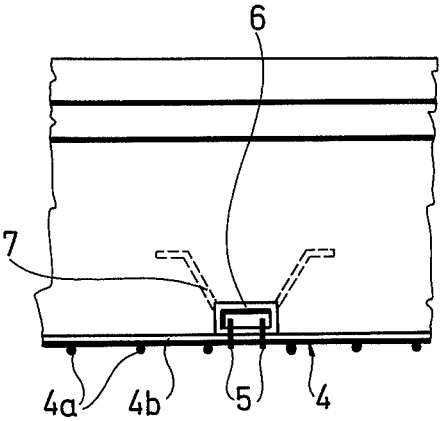

As is to be seen in larger proportion in FIGS. 2*a* and 2*b*, to the bottom part of the floor unit 1*a* steel mat 4 consisting of steel wires 4*a* and 4*b* intersecting each other is connected, fastened to the ribs 3*a*, 3*b* by means of flexible spikes 5. The spikes 5 are arranged in the boxes 6 concreted into the bottom part of the ribs 3*a* and 3*b*, which are anchored in the concrete material of the ribs by means of claws 7. These boxes are, of course, closed during the concreting by means of e.g. plastic foam inserts easily removable after the consolidation of the concrete.

Figure 3:
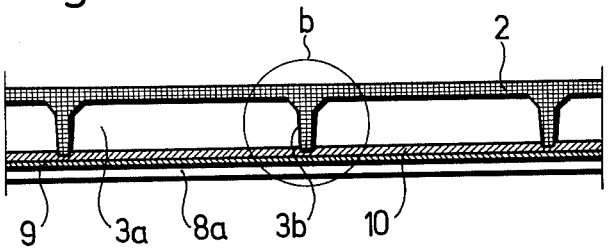
Figure 4:
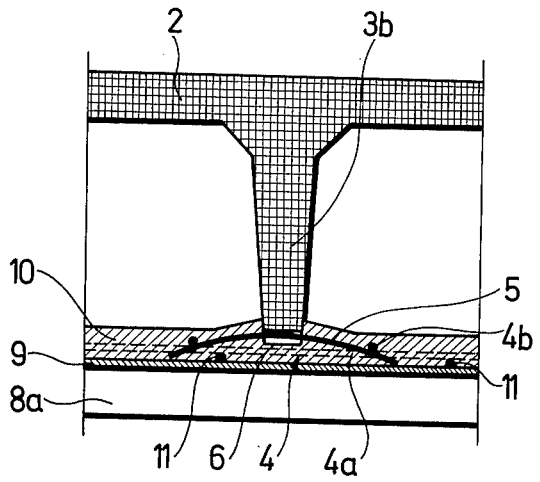

For carrying out the second phase of the process (this phase being represented in FIGS. 3 and 4) the floor unit part 1 equipped with steel mat 4 is arranged on the fresh concrete layer 10 spread over the pattern plate 9 reinforced with ribs 8*a* at the bottom, so that the steel mat 4 can be buried in the concrete layer 10. The thickness of the concrete layer 10 previously compacted to some extent by the vibration of the form plate 9 amounts generally to 2.5 to 3.0 cm; this concrete layer constitutes the smooth concrete plate on the ceiling side of the finished unit.

The vibration of the form plate 9 is continued after the iron armouring of the unit part is buried in the concrete layer 10 in the already described manner. The suitable distance of the steel mats 4 from the surface of the form plate is ensured by means of distance elements, the prescribed concrete cover of the iron armouring can be thus kept. As a result of the vibration operation, the material of the concrete layer closes above the steel mat 4, the concrete layer shrinks and thereby the production of the floor unit is finished and, after the consolidation of the concrete layer 10, it can be delivered to the site and can be built in.

Figure 5:
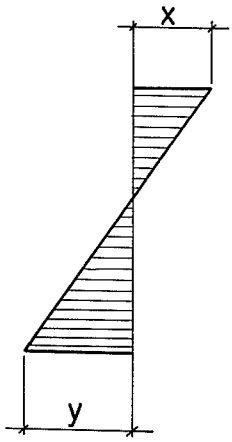
Figure 6:
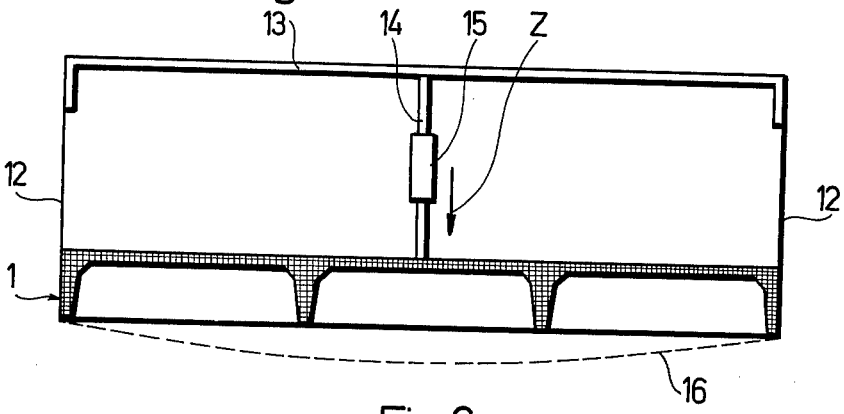

Although the reinforced concrete floor element made in the above described manner can be used in several fields, the crack-free floor plate of the ceiling is, however, not yet ensured by the accomplishment of the above measures. Thus in buildings where the freedom from cracks of the ceiling floor plates is required, they cannot be used. The invention has solved, however, this problem, too, and the production of floor panel having crack-free ceiling floor plates is carried out in the following manner, by the uni-plane or double-plane (spatial) span effected in the second phase:

The floor unit part 1 produced in the first phase and already consolidated is deformed by prestress in such a manner that its stress state should correspond to the stress diagram in FIG. 5; in this case, the compressive stress $x$ prevails in the plate 2 and the tensile stress $y$ in the lower part of the ribs 3*a* and 3*b*. The stress state according to FIG. 5 can be produced in the floor element part 1 e.g. in the manner schematically indicated in FIG. 6. Accordingly, the floor element part 1 is suspended around its periphery on the rocker 13 by means of suspension devices, for instance cables 12 or ropes and in between the rocker and the element, in the middle, the stretching device consisting for instance of screwed rods 14 and internally threaded sleeves 15 is inserted; other constructions, for instance hydraulically operated devices, can also be used, as the stretching device. The middle range of the element can be pressed downwards as compared to the rigid rocker 13 in the direction of arrow $z$ by means of the stretching device, so that its lower points arrange themselves along the downwardly convex line (highly exaggerated, of course) marked with dashed line in FIG. 6, that is, in the floor-element part 1 produced in the first phase of the process the stress state according to FIG. 5 prevails.

The floor-element part 1 prestressed in this way — to the bottom of which the steel mat 4 was connected before stressing in the already described manner — is arranged in this stressed state on the form plate 9 of the form or production tray, and the steel mat 4 merges into the fresh concrete layer 10. For this purpose, however, the shape of the form plate 9 shall correspond to the inclination line 16 drawn dashed in FIG. 6, that is, the form plate shall be concave when seen from above. Such a shape can be given to the form plate most expediently by means of the formwork according to the invention, shown in schematical side view in FIG. 7.

The frame-like carriage 8 of the formwork consists of supports crossing each other, on which screw spindle jacks 17 to be actuated bi-directionally are arranged in the required number. Each screw spindle jack 17 consists of two screwed rods 18 and of internally threaded sleeves 19 screwed to these threaded rod ends. The flexible form plate 9 — to which the side plates 9*a* are connected, the height of which practically corresponds to the thickness of the fresh concrete layer 10 and which is reinforced at the bottom with ribs 8*a* shown in larger proportion in FIG. 4 — is arranged on the screw spindle jacks 17, the upper ends of which are fastened to the bottom surface of the form plate 9 developed as a flexible device of low rigidity, reinforced with ribs. The internal threads of the sleeves 19 and the threads on the rod ends 18 are chosen so that with the rotation in one direction of the sleeves, the corresponding points of the form plate 9 can be raised, with the rotation in the opposite direction, however, they can be lowered. The screw spindle jacks 17 are distributed beneath the form plate in the required number and it is evident that the more jacks are used, the higher accuracy can be achieved in the adjustment of the required shape of form plate. It is easy to see that by means of this formwork the form plate 9 can be adjusted to an optional shape as planned, for instance to an arched shape corresponding to the dashed line 16, which corresponds to the deformation curve obtained as a result of the prestress of the floor-element part 1 and shown in FIG. 6.

Figure 7:
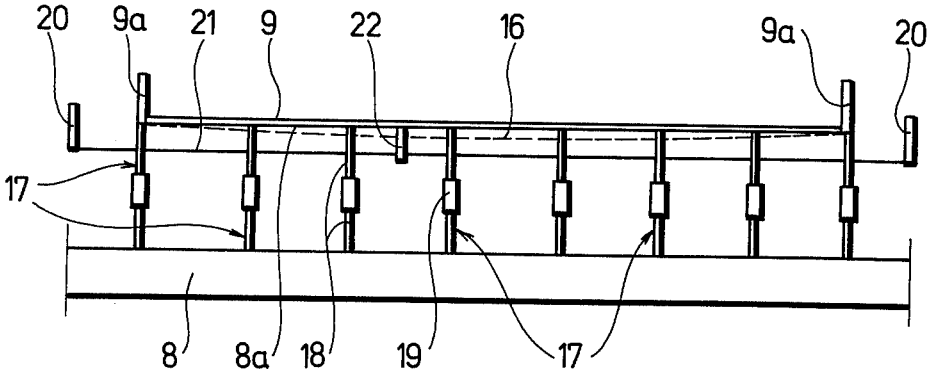
FIG. 7 shows an advantageous embodiment of the form according to the invention, in schematical side view.

The planned height of some points connected to the screw spindle jacks 17 of the form plate 9, for instance, can be adjusted so that beneath the form plate 9 a reference line is established in the form of a cord 21 fastened to the pins 20 independent of the formwork 9 and by means of e.g. measuring rules provided with millimeter calibration, fastened to the bottom of the form plate 9 the planned height of the individual points is adjusted (for the sake of better lucidity only one measuring rule is shown in FIG. 7).

The shape of the form plate 9 is adjusted therefore so as to correspond to the deformation line 16, that is, to the curve determined by the lower points of the floor-element part 1 prestressed in the above described manner. The floor-unit part 1 is kept in prestressed state until the fresh concrete layer 10 in which the steel mat 4 is merged, consolidates (see FIGS. 3 and 4). It should be noted that for the production of each building-unit type its curved surface shall be adjusted only once and shall be changed only if another type of building unit will be produced. Thereafter, the rocker 13 is detached from the building-unit part 1 by releasing the screw spindle 15, whereby the prestressed state ceases to exist (FIG. 5) and the building-unit part 1, seeking to recover the original unstressed shape, induces a compressive stress in the lower ceiling plate made of the consolidated raw concrete layer 10. The finished reinforced concrete floor unit is shown in FIG. 8 in which the lower plate under compressive stress is indicated with reference number 23. The detail *c* marked with a circle in FIG. 8 is shown in FIG. 9 in larger proportion. The finished floor unit thus consists of upper plate 2 and lower plate 23, of ribs 3*a* and 3*b* as well as of the closed coffered holes limited by the plates and ribs. The outer surfaces of plates 2 and 23 are smooth.

In FIG. 10 the diagram indicating the stress state of the floor element according to FIG. 8 is shown, the element being unloaded. In the upper plate 2 a compressive stress $x'$, whereas in the lower ends of the ribs 3*a* and 3*b* a tensile stress $y'$ prevails. The amount of the compressive stress applied to the lower plate 23 in the above described manner is marked by $w$.

Comparing the stress state according to FIG. 5 with that according to FIG. 10, it may be stated that the compressive stress in the upper plate 2 is lower ($x' < x$) and the tensile stress is reduced also in the ribs ($y' < y$), whereas a considerable compressive stress $w$ prevails in the lower plate 23. Under the effect of the working load the stresses in the floor unit are formed as indicated in FIG. 11, that is, the compressive stress in the upper plate 2 increases to a value $x''$ and the tensile stress in the lower ends of ribs 3*a* and 3*b* to a value $y''$, whereas in the lower plate 23 a reserve compressive stress of value $w'$ prevails, providing in any case for the freedom from cracks of the lower plate. Therefore, the building unit according to the invention works optimally in every respect under the effect of the working load.

The invention is not limited, of course, to the above described possible solutions but several variations within the frame-work of the protection determined by the claims can be realized. Thus, for instance, not only floor elements, but building units for other purposes can be produced by this process. The prestress of the element can be achieved not only by means of the introduced rocker but in whatever suitable manner. A solution deviating from the described screw spindle mechanism may be similarly used for the adjustment to the planned shape of the flexible form plates; the same is true for the development of the reference system, too. With respect to several partial solutions, modifications are feasible without, however, departing from the scope of the invention as defined by the claims.

What we claim is:

1. A process for the production of compressive prestressed reinforced concrete building units having smooth opposite surfaces and coffer-like inner holes, comprising connecting a mat of steel rods to the edges of ribs which are secured to a flat panel, pouring a layer of concrete onto a horizontal form plate the size of said panel, immersing said mat and rib edges in said concrete, vibrating said plate and panel to consolidate the concrete around the rods of said mat, prestressing said unit by flexing both said panel and said plate to the same upwardly concave curvature prior to hardening of said concrete, and then removing said plate and releasing the flexing of said panel after the concrete has hardened.

2. A process as claimed in claim 1, and connecting said mat to said ribs by fastening means secured to said ribs.

* * * * *